United States Patent [19]

Gorin et al.

[11] 4,030,982

[45] June 21, 1977

[54] PROCESS OF MAKING FORMCOKE FROM NON-CAKING OR WEAKLY CAKING COALS

[75] Inventors: Everett Gorin, Pittsburgh; William A. Jasulaitis, Bridgeville; Frank W. Theodore, Pittsburgh; George E. Wasson, Eighty-Four, all of Pa.

[73] Assignee: Consolidation Coal Company, Pittsburgh, Pa.

[22] Filed: July 10, 1975

[21] Appl. No.: 594,906

[52] U.S. Cl. ..... 201/6; 201/22; 201/23; 208/45

[51] Int. Cl.[2] ..... C10B 53/08; C10B 55/00

[58] Field of Search ..... 201/6, 21, 22, 5, 23; 208/8, 45

[56] References Cited

UNITED STATES PATENTS

| | | | |
|---|---|---|---|
| 2,556,154 | 6/1951 | Kern | 201/6 |
| 3,162,594 | 12/1964 | Gorin | 208/8 X |
| 3,401,089 | 9/1968 | Friedrich et al. | 201/6 |
| 3,562,783 | 2/1971 | Gorin | 201/6 |
| 3,748,254 | 7/1973 | Gorin | 208/8 |
| 3,791,956 | 2/1974 | Gorin et al. | 208/8 |

*Primary Examiner*—Morris O. Wolk
*Assistant Examiner*—Arnold Turk
*Attorney, Agent, or Firm*—William A. Mikesell, Jr.; D. Leigh Fowler, Jr.; Stanley J. Price, Jr.

[57] ABSTRACT

Formcoke suitable for use in a blast furnace is made from a non-caking or weakly caking coal by converting the coal to an agglomeratable material consisting essentially of a blend of the entire product (without separation of extract and undissolved solids) obtained by solvent extraction of the coal in the presence of hydrogen and a suitable amount of hydrocarbonaceous solids. The agglomeratable material is agglomerated under low temperature carbonizing conditions and the agglomerates are thereafter calcined to produce strong formcoke.

4 Claims, 1 Drawing Figure

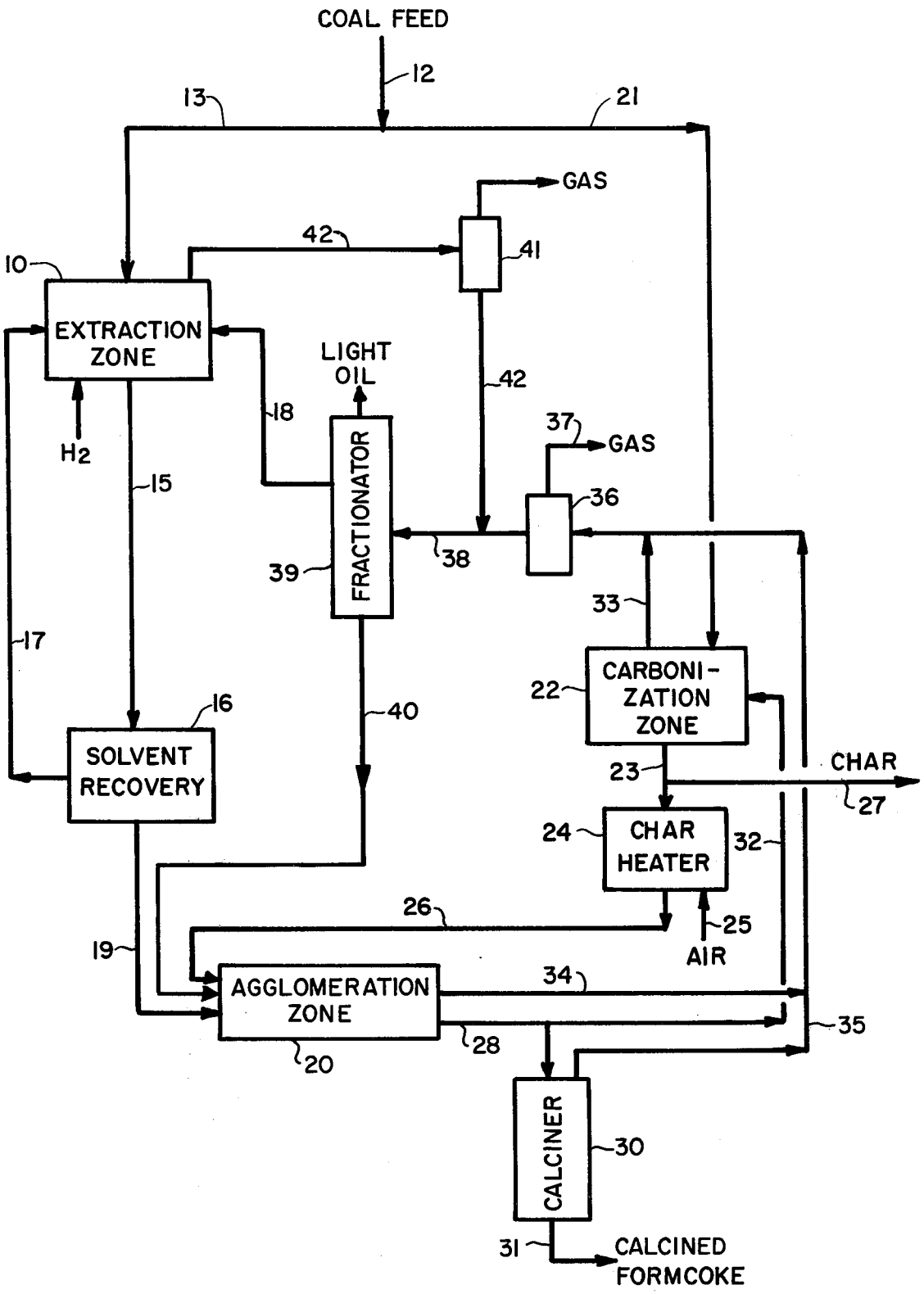
COAL FEED
12
13
21
GAS
42
41
10
EXTRACTION ZONE
LIGHT OIL
42
18
37
GAS
H2
15
36
FRACTIONATOR
38
39
33
17
CARBONI-ZATION ZONE
22
16
40
SOLVENT RECOVERY
23
CHAR
27
24
CHAR HEATER
32
26
25
AIR
19
AGGLOMERATION ZONE
34
35
28
20
CALCINER
30
31
CALCINED FORMCOKE

PROCESS OF MAKING FORMCOKE FROM NON-CAKING OR WEAKLY CAKING COALS

This invention relates to the production of formcoke from a normally non-caking or a weakly caking coal and, more particularly, to the production of formcoke which is suitable for use in conventional blast furnaces.

The term "formcoke" is applied to coke which is obtained by the calcination of preformed or preshaped hydrocarbonaceous solids. The term is used to distinguish from coke obtained as broken pieces of all sizes and shapes from conventional slot-type coke ovens. There are many mechanical ways of preforming or preshaping carbonaceous solids, for example, by extrusion, by briquetting in molds, or by pelletizing in cylindrical kilns or drums which rotate about a substantially horizontal axis. In the latter case, the carbonaceous solids, in a plastic condition, are tumbled to form discrete agglomerates or pellets. For the purposes of describing the claiming the present invention, the term "agglomerates" includes the products made by any of these methods; the term "green formcoke" means agglomerates which have been subjected to carbonization at low temperature, i.e. below about 650° C.; and the term "formcoke" means the product obtained by calcination of the green formcoke.

The process of this invention is an improvement of the process described in U.S. Pat. No. 3,562,783, issued to Everett Gorin on Feb. 9, 1971. That process is a process for making agglomerates from non-caking or weakly caking coals which includes tumbling in a rotary kiln, at an elevated forming temperature, hydrocarbonaceous material obtained from the coal feedstock and a binder also obtained from the coal feedstock to form green agglomerates. The binder contains a non-distillable coal extract fraction which is initially fluid at the forming temperature in the kiln. The non-distillable coal extract fraction is obtained by solvent extraction of the coal feedstock. According to the drawings and accompanying description thereof, the coal extract fraction is first substantially separated from the solid residue which is also contained in the solvent extraction effluent, before being used as the aforementioned binder.

In accordance with the present invention, the non-caking or weakly caking coal is subjected to solvent extraction in the presence of hydrogen available at extraction conditions; that is, the hydrogen may be extraneously added or be derived from a hydrogen-donor solvent which gives up hydrogen under the extraction conditions. A product is obtained which contains a mixture of coal extract and undissolved solid residue from which the solvent may or may not have been removed, in whole or in part. The extraction product is blended, generally after most of the solvent has been removed but without deliberate separation of the extract and the residue from each other, with finely divided hydrocarbonaceous solids. The hydrocarbonaceous solids may be coal which is preferably a low volatile coal, or may be solids derived by the pyrolysis of coaly materials. The latter solids are sometimes referred to as char. Agglomerates are formed from the blended product by any suitable means, and these agglomerates are then subjected to low temperature carbonization to yield green formcoke. The green formcoke is subjected to calcination to yield formcoke suitable for use in a blast furnace.

For a better understanding of our invention and its objects and advantages, reference should be had to the accompanying drawing in which a preferred embodiment of our invention is schematically illustrated, and to the following description.

A weakly caking coal is introduced into a coal extraction zone 10 through conduits 12 and 13. The coal had the following pertinent specifications: % volatile matter (dry basis) = 41.4; % ash – 8.7; % S – 3.00; FSI (Free Swelling Index) (ASTM-D720-67) = 2½; and Gieseler Fluidity (DDPM — Dial Division Per Minute) (ASTM-D1812-69) = 1.1.

A suitable liquefaction solvent for use in the Extraction Zone 10 is a mixture of polycyclic aromatic hydrocarbons which is liquid under the conditions of temperature and pressure maintained during coal liquefaction. A suitable boiling range for such a solvent, for example, is within the range 230° to 475° C. The solvent may be conveniently derived as a distillate fraction from one or more of the unit operations of the present process. If so, such a solvent may contain phenols and heterocyclic compounds as well as the polycyclic hydrocarbons.

The selected coal, in a finely divided state, is subjected, in the extraction zone 10, to solvent extraction in the presence of hydrogen available at the extraction conditions. The extraction operation may be any of those used by those skilled in the art, for example, continuous, batch, countercurrent or staged extraction. Hydrogen for the hydrotreatment is preferably supplied as gaseous hydrogen as shown in the drawing. However, it may be supplied by means of a hydrogen-donor solvent. If gaseous hydrogen is used, the solvent may be any suitable polycyclic aromatic hydrocarbon, or mixtures of polycyclic aromatic hydrocarbons which are liquid at the temperature and pressure of extraction, and derived from the process itself as previously mentioned. If a hydrogen-donor solvent is used, at least a portion of the polycylic aromatic hydrocarbons is partially hydrogenated. Such a solvent is suitably rehydrogenated to maintain its effectiveness as a hydrogen donor.

The conditions maintained in the Extraction Zone 10 are typically as follows:

| | |
|---|---|
| Temperature, ° C. | 400 – 450 |
| Pressure, Kg/cm² | 30 – 200 |
| H addition, Wt. % MAF* coal | 0.70 – 2.5 |
| Solvent to coal (wt. ratio) | 1.5 – 3.0 |

*MAF is moisture- and ash-free coal.

The product consists of an effluent gas (containing $H_2S$) and an effluent slurry product (containing solvent, extract and residue, i.e. undissolved hydrocarbonaceous solids and ash) which is conducted by a conduit 15 to a solvent recovery zone 16. In this zone, most of the solvent is recovered by distillation and recycled by a conduit 17 to the Extraction Zone 10. Make-up solvent is added as needed through a conduit 18. The extraction product, consisting essentially of extract and residue, with preferably enough solvent to render the mixture pumpable, is transferred through a conduit 19 to an Agglomeration Zone 20.

In the preferred embodiment of our invention, not all the coal is necessarily sent to the Extraction Zone 10. A part may be fed directly via a conduit 21 to a low temperature carbonization zone 22. This zone operates at about 500° C., its function being to convert the coal to char and tar. The char is transferred by a conduit 23 to a char heating zone 24 wherein the char is heated to a temperature between 550° and 650° C. by combustion with air introduced through a conduit 25. In the event more char is produced in the carbonization zone 22 than is needed in the process, the excess may be withdrawn through a conduit 27. The hot char is carried by a conduit 26 to the Agglomeration Zone 20.

The Agglomeration Zone 20 is preferably a rotary kiln which is adapted to rotate about its longitudinal axis and serves to tumble the hot char and extraction product together as they advance through the kiln. If deemed necessary, some of the feed coal, as well as pitch produced in the process, may also be added to the kiln feed to obtain optimum size formation of green agglomerates. The temperature of the char as introduced is selected so as to maintain the temperature of the tumbling mixture adiabatically between about 385° and 475° C. Green agglomerates having a predetermined size are withdrawn through an outlet conduit 28 and fed to a calcining zone 30 where they are heated to an elevated temperature sufficiently high to remove substantially all volatile matter. The calcined product is withdrawn through a conduit 31. Offsize green agglomerates are recycled, after suitable comminution, through a conduit 32 to the low temperature carbonization zone 22. These recycled agglomerates may be in sufficient amount under certain conditions of operations and with certain coals to remove the need for low temperature carbonization of part of the feed coal through line 21 as shown in the drawing. The amount of char required for blending with the extraction product is a function of the depth of Extraction Zone 10. The greater the depth of extraction, the larger the amount of char required.

The solvent for the extraction of the coal in the Extraction Zone 10 is derived as follows: Tar is produced in the low temperature zone 22, the char heater 24, the rotary kiln 20, and the calciner 30. This tar is conducted by conduits 33, 34 and 35 to a tar recovery zone 36 where any gas is separated and discharged through a conduit 37. The tar itself is transferred via a conduit 38 to a fractionating still 39. The latter serves to split the tar into a light overheat distillate boiling below about 230° C., a middle distillate portion boiling between about 230° C. and 400° C., and lastly a pitch fraction. The middle distillate fraction supplies the makeup solvent for the extraction zone through conduit 18 while the pitch fraction, or part of it, may be fed through conduit 40 to the Agglomeration Zone as binder supplement, as mentioned before. Additional solvent may be generated within the extraction process itself. The lower boiling distillates, for example, are vaporized with the hydrogen in the extraction process. These are condensed, separated from the gas in a separator 41, and returned to the fractionator 39 through a conduit 42 and the conduit 38. The cut point of the light distillate product may be varied to maintain a constant solvent inventory, i.e. as the amount of solvent generated increases the amount retained in the system can be maintained by raising the cut point.

EXAMPLE

Following is an example of the operation of the above-described preferred embodiment where only recycle char was used as the carbonaceous solids blended with the extraction product. That is, no char made directly by low temperature carbonization of the feed coal was needed. Hence, all the coal feed was subjected to extraction under the following typical conditions.

TABLE I

| Typical Extraction Conditions | |
|---|---|
| Solvent | Recycle Solvent* |
| Solvent to Coal Ratio | 3/1 |
| Pressure | 119.5 Kg/cm² |
| Temperature | 496° C. |
| Residence Time | 45 minutes |
| Hydrogen Consumption | 2% by weight |
| Coal Conversion, MAF** | 90–95% |

*The solvent was produced in the process as a distillate boiling between 230 and 425° C.
**Moisture- and ash-free basis.

The conditions in the kiln and results of tests on the product from a typical run are presented in the following Table II.

TABLE II

| | |
|---|---|
| Feed: | |
| Extraction Product, wt. % | 43.2* |
| Char, Wt. % 56.8 | |
| *Includes 2.9% solvent | |
| Forming Temperature, ° C. | |
| Minimum | 401 |
| Maximum | 427 |
| Residence Time, minutes | 30 |
| Product Size Consist, Wt. % | |
| +2" | 0 |
| 1 ½ × 2" | 6.6 |
| 1 × 1 ½" | 22.1 |
| ¾ × 1" | 27.1 |
| ½ × ¾" | 30.2 |
| −½" | 14.0 |
| Tumbler Analysis* | |
| +¾" Stability | 73.3 |
| +¼" Hardness | 82.2 |

*The procedure for the Tumbler Analysis is as follows: Charge the following amounts of calcined coke to a standard ASTM Coke Tumbler (D-294): 3500 gms. of 2" × 1 ½" (5.08 cm × 3.81 cm), 3500 gms. of 1 ½ × 1" (3.81 cm × 2.54 cm), and 3000 gms. of 1" × ¾" (2.54 cm × 1.90 cm). Rotate the coke in the tumbler for 1400 revolutions at 25 rpm. Empty the tumbler and screen the coke over 1 ½", 1", ¾", ½" and ¼" (3.81 cm, 2.54 cm, 1.90 cm, 1.27 cm and .62 cm respectively) screens. The total weight percent +¾" (1.90 cm) is the Stability Index and the total weight percent +¼" (.62 cm) is the Hardness Index.

According to the provisions of the patent statutes, the principle, preferred construction and mode of operation of the invention have been explained and what is considered to represent its best embodiment has been illustrated and described. However, it should be understood that, within the scope of the appended claims, the invention may be practiced otherwise than as specifically illustrated and described.

We claim:

1. In the process of making formcoke from a normally non-caking or weakly caking coal wherein a mixture of carbonaceous solids and carbonaceous binder derived from said coal is tumbled under adiabatic conditions at an elevated temperature in a rotary kiln adapted to rotate about its longitudinal axis, to thereby form agglomerates having a predetermined size which are thereafter calcined to produce formcoke suitable for use in a blast furnace, the improvement comprising:

a. subjecting said coal, in a finely divided state, to solvent extraction in a solvent extraction zone in the presence of hydrogen under extraction conditions to thereby produce a product consisting of an effluent gas and an effluent slurry;

b. subjecting said effluent slurry to distillation in a solvent recovery zone, to thereby recover at least part of the solvent as distillate;

c. blending the undistilled remainder of said effluent slurry and any feed coal and any pitch that may be added, with sufficient hot char to maintain the blended product at a forming temperature between about 385° and 475° C. in said rotary kiln;

d. tumbling said blended product in said rotary kiln until agglomerates of predetermined size are formed; and thereafter e. heating said agglomerates in a calcining zone until formcoke is produced which is suitable for use in a blast furnace.

2. A process according to claim 1 wherein said extraction conditions of said solvent extraction zone are as follows:

| | |
|---|---|
| Temperature, ° C. | 400 – 450 |
| Pressure, Kg/cm² | 30 – 200 |
| H addition, Wt. % MAF coal | 0.70 – 2.5 |
| Solvent to coal (wt. ratio) | 1.5 – 3.0 |

3. A process according to claim 2 wherein sufficient solvent is left in said effluent slurry to render it pumpable.

4. A process according to claim 3 wherein said hot char includes comminuted off-size agglomerates from said rotary kiln.

* * * * *